US008485625B2

(12) United States Patent
Miyazawa et al.

(10) Patent No.: US 8,485,625 B2
(45) Date of Patent: Jul. 16, 2013

(54) FLUID EJECTING APPARATUS AND FLUID EJECTING METHOD

(75) Inventors: Yoshio Miyazawa, Shiojiri (JP); Toshiki Usui, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 564 days.

(21) Appl. No.: 12/616,294

(22) Filed: Nov. 11, 2009

(65) Prior Publication Data

US 2010/0118075 A1 May 13, 2010

(30) Foreign Application Priority Data

Nov. 12, 2008 (JP) ..... 2008-290172

(51) Int. Cl.
*B41J 29/38* (2006.01)

(52) U.S. Cl.
USPC ..... 347/11

(58) Field of Classification Search
USPC ..... 347/11
See application file for complete search history.

(56) References Cited

U.S. PATENT DOCUMENTS

| | | | | |
|---|---|---|---|---|
| 6,247,776 | B1 * | 6/2001 | Usui et al. | 347/11 |
| 6,352,335 | B1 * | 3/2002 | Koyama et al. | 347/37 |
| 6,357,846 | B1 * | 3/2002 | Kitahara | 347/10 |
| 6,450,603 | B1 * | 9/2002 | Chang | 347/10 |
| 7,278,698 | B2 * | 10/2007 | Tamura | 347/11 |
| 7,494,199 | B2 * | 2/2009 | Aoki | 347/9 |
| 2002/0018085 | A1 * | 2/2002 | Asauchi et al. | 347/10 |
| 2006/0238554 | A1 * | 10/2006 | Hosono et al. | 347/11 |

FOREIGN PATENT DOCUMENTS

| | | |
|---|---|---|
| JP | 2000-052560 | 2/2000 |
| JP | 2000-052570 | 2/2000 |
| JP | 2005-224998 | 8/2005 |
| JP | 2006-205720 | 8/2006 |
| JP | 2006-272896 | 10/2006 |
| JP | 2007-210246 | 8/2007 |
| JP | 2007-210247 | 8/2007 |
| JP | 2008-114411 A | 5/2008 |
| JP | 2008-137345 | 6/2008 |

* cited by examiner

*Primary Examiner* — Charlie Peng
(74) *Attorney, Agent, or Firm* — Maschoff Brennan

(57) ABSTRACT

A fluid ejecting apparatus includes a drive element that performs a driving operation when a drive waveform is applied thereto and causes a nozzle to eject fluid. A drive signal generating unit generates a first drive signal having a first drive waveform at a front section of a predetermined period and a second drive waveform at a rear section thereof. A second drive signal has a third drive waveform at a front section of the predetermined period and a fourth drive waveform at a rear section thereof. A control unit applies the first drive waveform to the drive element, which then performs a first operation, applies the fourth drive waveform to the drive element, which then performs a second operation, and applies the second drive waveform to the drive element after applying the third drive waveform thereto, so that the drive element performs a third operation.

8 Claims, 12 Drawing Sheets

| | | | | | | | SELECTION DATA |
|---|---|---|---|---|---|---|---|
| SI(00) MINUTE VIBRATION | COM(1) | T10 | | | T11 | T12 | q0(001) |
| | | × | | | × | ○ | |
| | COM(2) | T20 | T21 | T22 | | | q3(100) |
| | | ○ | × | × | | | |
| SI(01) SMALL DOT | COM(1) | T10 | | | T11 | T12 | q1(100) |
| | | ○ | | | × | × | |
| | COM(2) | T20 | T21 | T22 | | | q4(000) |
| | | × | × | × | | | |
| SI(10) LARGE DOT | COM(1) | T10 | | | T11 | T12 | q2(000) |
| | | × | | | × | × | |
| | COM(2) | T20 | T21 | T22 | | | q5(001) |
| | | × | × | ○ | | | |

| | | | | | | | SELECTION DATA |
|---|---|---|---|---|---|---|---|
| SI(00) MINUTE VIBRATION | COM(1) | T13 | | T14 | T15 | T16 | q0(0001) |
| | | × | | × | × | ○ | |
| | COM(2) | T23 | T24 | T25 | | T26 | q3(1000) |
| | | ○ | × | × | | × | |
| SI(01) SMALL DOT | COM(1) | T13 | | T14 | T15 | T16 | q1(1000) |
| | | ○ | | × | × | × | |
| | COM(2) | T23 | T24 | T25 | | T26 | q4(0001) |
| | | × | × | × | | ○ | |
| SI(10) LARGE DOT | COM(1) | T13 | | T14 | T15 | T16 | q2(0000) |
| | | × | | × | × | × | |
| | COM(2) | T23 | T24 | T25 | | T26 | q5(0011) |
| | | × | × | ○ | | ○ | |

FLUID EJECTING APPARATUS AND FLUID EJECTING METHOD

BACKGROUND

1. Technical Field

The present invention relates to a fluid ejecting apparatus and a fluid ejecting method.

2. Related Art

An ink jet printer that applies a drive waveform to a drive element to eject ink from a nozzle corresponding to the drive element is known as a fluid ejecting apparatus. The amount of the ink ejected from the nozzle can be varied by changing the shape of a drive waveform repeatedly generated for a predetermined period. However, for example, if drive waveforms are sequentially generated in a predetermined period of one drive signal, the predetermined period becomes longer as the number of drive waveforms increases, making printing time longer.

Therefore, a printer that generates a first drive signal in which drive waveforms are repeatedly generated for a predetermined period and a second drive signal in which drive waveforms different from those of the first drive signal are repeatedly generated for a predetermined period so that the drive waveforms of the first drive signal and the drive waveforms of the second drive signal are selectively applied to a drive element has been suggested (For example, refer to JP-A-2000-52570.).

However, since it is necessary to make the predetermined periods of the first and second signals the same, the predetermined period is determined according to the drive signal whose time period for generating drive waveforms is longer. Therefore, if the numbers of the drive waveforms are different or the lengths of the drive waveforms are different in the first drive signal and the second drive signal, a gap is generated between the time periods for which the drive waveforms are generated. As a result, the predetermined period becomes longer, making printing time longer.

SUMMARY

An advantage of some aspects of the invention is that it provides a fluid ejecting apparatus and a fluid ejecting method that shorten the predetermined period.

In order to achieve the above-described object, there is provided a fluid ejecting apparatus comprising: a drive element that performs a driving operation when a drive waveform is applied thereto; a nozzle that ejects a fluid by the driving operation of the drive element; a drive signal generating unit that generates a first drive signal in which a first drive waveform is generated at a front section of a predetermined period and a second drive waveform is generated at a rear section of the predetermined period and a second drive signal in which a third drive waveform is generated at a front section of the predetermined period and a fourth drive waveform is generated at a rear section of the predetermined period; and a control unit that applies the first drive waveform to the drive element so that the drive element performs a first operation, applies the fourth drive waveform to the drive element so that the drive element performs a second operation, and applies the second drive waveform to the drive element after applying the third drive waveform to the drive element, so that the drive element performs a third operation.

BRIEF DESCRIPTION OF THE DRAWINGS

The invention will be described with reference to the accompanying drawings, wherein like numbers reference like elements.

DESCRIPTION OF EXEMPLARY EMBODIMENTS

Summary of Disclosure

Figure 1A:
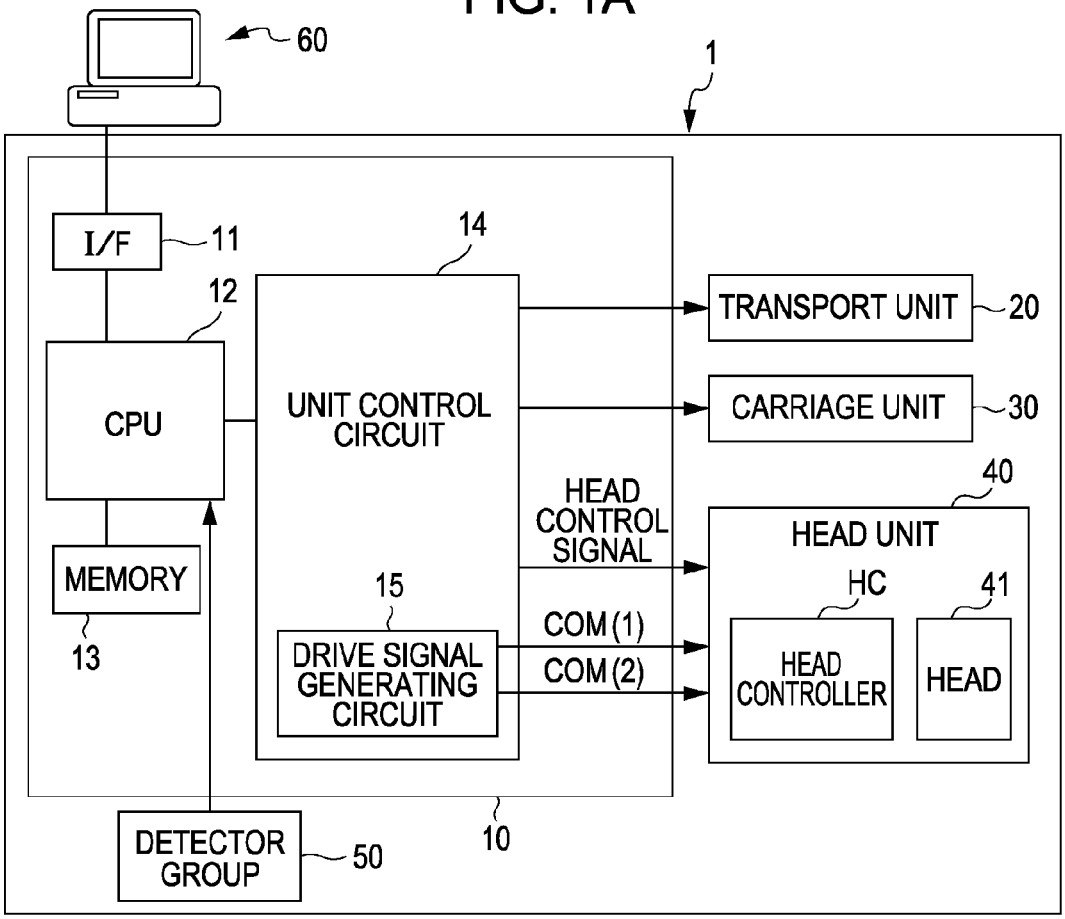
FIG. 1A is a block diagram of an entire configuration of a printer.

The other features of the invention will be apparent from the description of the specification and the accompanying drawings.

A fluid ejecting apparatus includes: a drive element that performs a driving operation when a drive waveform is applied thereto; a nozzle that ejects a fluid by the driving operation of the drive element; a drive signal generating unit that generates a first drive signal in which a first drive waveform is generated at a front section of a predetermined period and a second drive waveform is generated at a rear section of the predetermined period and a second drive signal in which a third drive waveform is generated at a front section of the predetermined period and a fourth drive waveform is generated at a rear section of the predetermined period; and a control unit that applies the first drive waveform to the drive element so that the drive element performs a first operation, applies the fourth drive waveform to the drive element so that the drive element performs a second operation, and applies the second drive waveform to the drive element after applying the third drive waveform to the drive element, so that the drive element performs a third operation.

According to the fluid ejecting apparatus, the predetermined period can be made as short as possible.

A time period for which the first drive waveform is generated is longer than half the predetermined period, and a time period for which the fourth drive waveform is generated is longer than half the predetermined period.

According to the fluid ejecting apparatus, the degree of freedom in the design of the first drive waveform and the fourth drive waveform can be increased.

An amount of the fluid ejected from the nozzle corresponding to the drive element by the first operation of the drive element is smaller than an amount of the fluid ejected from the nozzle corresponding to the drive element by the second operation of the drive element.

According to the fluid ejecting apparatus, the first operation of the drive element is rarely influenced by the fourth operation of another drive element, so that a small amount of fluid can be more accurately ejected by the first operation of the drive element.

A final potential of the third drive waveform is equal to an initial potential of the second drive waveform.

According to the fluid ejecting apparatus, the drive element to which the third drive waveform is applied can maintain the predetermined potential for a relatively long time period until the second drive waveform is applied while shortening the period.

The fluid is not ejected from the nozzle corresponding to the drive element but a meniscus minutely vibrates by the third operation of the drive element.

According to the fluid ejecting apparatus, the drive element can maintain the predetermined potential for a relatively long time period to restrain the fluid from being ejected from the nozzle while shortening the predetermined period.

A fifth drive waveform is generated behind the fourth drive waveform in the second drive signal, and the control unit applies the fifth drive waveform to the drive element after applying the first drive waveform to the drive element, so that the drive element performs the first operation, and applies the fifth drive waveform after applying the fourth drive waveform to the drive element, so that the drive element performs the second operation.

According to the fluid ejecting apparatus, the drive element to which the first drive waveform is applied can maintain the predetermined potential for a relatively long time period until the fifth drive waveform is applied while shortening the predetermined period.

A sixth drive waveform whose potential is varied from a final potential of the first drive waveform to a midpoint potential is generated behind the first drive waveform in the first drive signal, the potential of the fifth drive waveform is varied from a final potential of the fourth drive waveform to the midpoint potential, the final potential of the first drive waveform is equal to the final potential of the fourth drive waveform, and a time period for which the sixth drive waveform is generated is shorter than a time period for which the fifth drive waveform is generated.

According to the fluid ejecting apparatus, the predetermined period can be shortened further.

A fluid ejecting method in which a drive element performs a driving operation when a drive waveform is applied thereto so that a nozzle corresponding to the drive element ejects a fluid, includes: generating a first drive signal in which a first drive waveform is generated at a front section of a predetermined period and a second drive waveform is generated at a rear section of the predetermined period and a second drive signal in which a third drive waveform is generated at a front section of the predetermined period and a fourth drive waveform is generated at a rear section of the predetermined period; applying the first drive waveform to the drive element so that the drive element performs a first operation; applying the fourth drive waveform to the drive element so that the drive element performs a second operation; and applying the second drive waveform to the drive element after applying the third drive waveform to the drive element, so that the drive element performs a third operation.

According to the fluid ejecting method, the predetermined period can be made as short as possible.

Constitution of Ink Jet Printer

Hereinafter, a fluid ejecting apparatus is an ink jet printer, and a serial printer (printer 1) will be illustrated as an example of the ink jet printer to explain an embodiment of the ink jet printer.

Figure 1B:
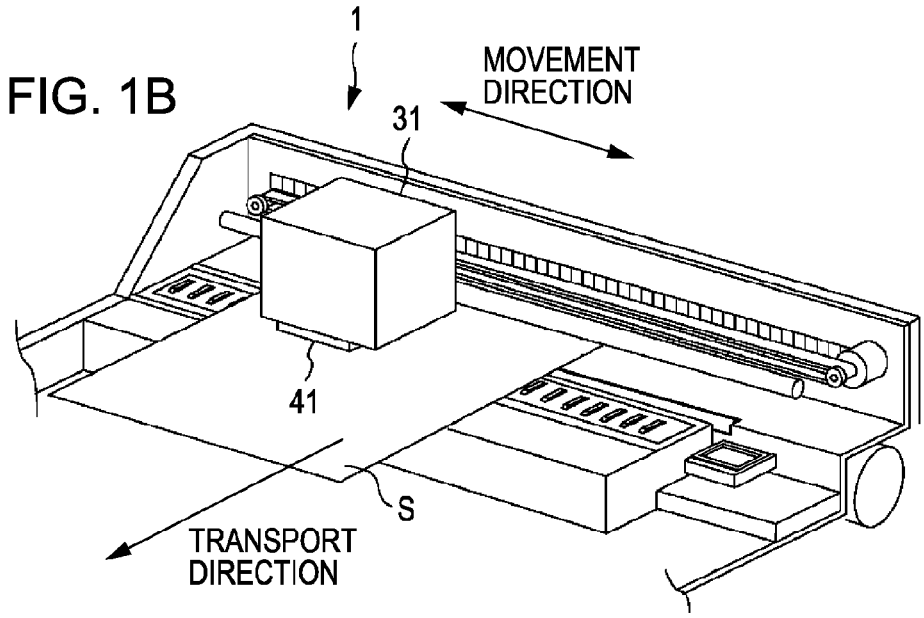
FIG. 1B is a perspective view of a portion of the printer.

FIG. 1A is a block diagram of an entire configuration of a printer 1 according to an embodiment of the invention, and FIG. 1B is a perspective view illustrating a portion of the printer 1. In the printer 1 that has received printing data from a computer 60, i.e. an external device, units (a transport unit 20, a carriage unit 30, and a head unit 40) are controlled by a controller 10 to form an image on a paper sheet (medium) S. A detector group 50 monitors the situation inside the printer 1, and the controller 10 controls the units based on the detection result.

The controller 10 is a control unit for controlling the printer 1. Data can be transmitted and received between the computer 60, i.e. an external device and the printer 1 through an interface 11. A CPU 12 is a processing unit for controlling the entire printer 1. A memory 13 secures a region in which a program of the CPU 12 is stored or a work region. The CPU 12 controls the units using a unit control circuit 14.

The transport unit 20 sends the paper sheet S to a position where a printing operation is enabled and transports the paper sheet S by a predetermined transport amount in the transport direction during a printing operation. The carriage unit 30 moves a head 41 mounted to a carriage 31 in a direction (hereinafter, referred to as "movement direction") crossing the transport direction.

The head unit 40 discharges ink to the paper sheet S, and has a head 41 and a head controller HC. A plurality of nozzles, i.e. ink discharging portions, is provided on the bottom surface of the head 41. Ink droplets are discharged from the corresponding nozzles by deforming piezo elements (corresponding to drive elements) based on a head control signal from the controller 10 or a drive signal COM from a drive signal generating circuit 15.

The serial printer 1 alternately repeats a dot forming process in which dots are formed on a paper sheet S and a transport process in which the paper sheet S is transported in the transport direction by intermittently discharging ink from the head 41 moving along the movement direction and forms dots at different positions from the dots formed by the above-dot forming process to finish an image.

Drive of Head 41

Constitution of Head 41

Figure 2A:
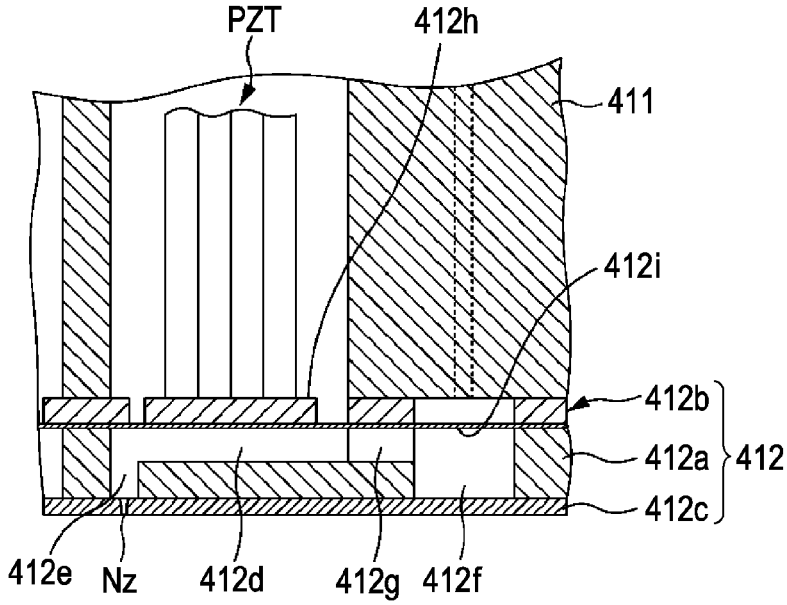
FIG. 2A is a sectional view of a head.
Figure 2B:
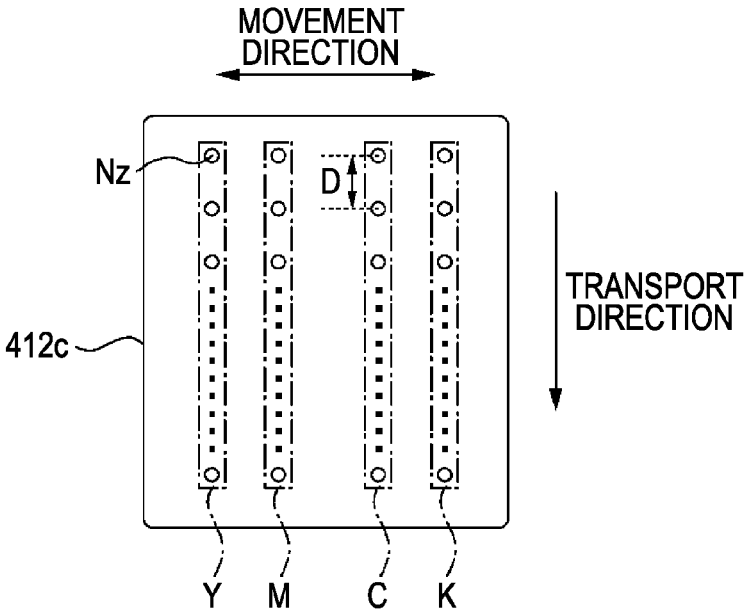
FIG. 2B is a view illustrating a nozzle surface of the head.

FIG. 2A is a sectional view of a head 41, and FIG. 2B is a view illustrating a nozzle surface of the head 41. The body of the head 41 has a case 411, a passage unit 412, and a piezo element group PZT. The case 411 receives the piezo element group PZT, and the passage unit 412 is bonded to the bottom surface of the case 411.

The passage unit 412 has a passage defining plate 412*a*, a resilient plate 412*b*, and a nozzle plate 412*c*. A recess, i.e. a pressure chamber 412*d*, a through-opening, i.e. a nozzle communication opening 412*e*, a through-opening, i.e. a common ink chamber 412*f*, a recess, i.e. an ink supply passage 412*g* are formed in the passage defining plate 412*a*. The resilient plate 412*b* has an island portion 412*h* to which the tip end of the piezo element PZT is bonded. A resilient region is formed near the island portion 412*h* by a resilient membrane 412*i*. The ink stored in an ink cartridge is supplied to the pressure chamber 412*d* corresponding to the nozzles Nz through the common ink chamber 412*f*.

The nozzle plate 412*c* is a plate in which the nozzles Nz are formed as in FIG. 2A. A yellow nozzle row Y for discharging yellow ink, a magenta nozzle row M for discharging magenta ink, a cyan nozzle row C for discharging cyan ink, and a black nozzle row K for discharging black ink are formed on the nozzle surface. Nozzles Nz are disposed in the transport direction by a predetermined distance D in each nozzle row.

The piezo element group PZT has a plurality of hatched piezo elements (drive elements), and a number of the piezo element groups PZT corresponds to the number of the nozzles Nz. A drive signal COM is applied to the piezo elements through a wired substrate (not shown) to which the head controller HC is mounted, so that the piezo elements are flexibly deformed upward and downward depending on the potential of the drive signal COM. If the piezo elements PZT are flexibly deformed, the island portion 412*h* is pressed toward the pressure chamber 412*d* or is attracted in the opposite direction. Then, the resilient membrane 412*i* near the island portion 412*h* is deformed, and ink droplets are discharged from the nozzle by increasing or decreasing the pressure of the pressure chamber 412*d*.

Drive Signal Generating Circuit 15

Figure 3A:
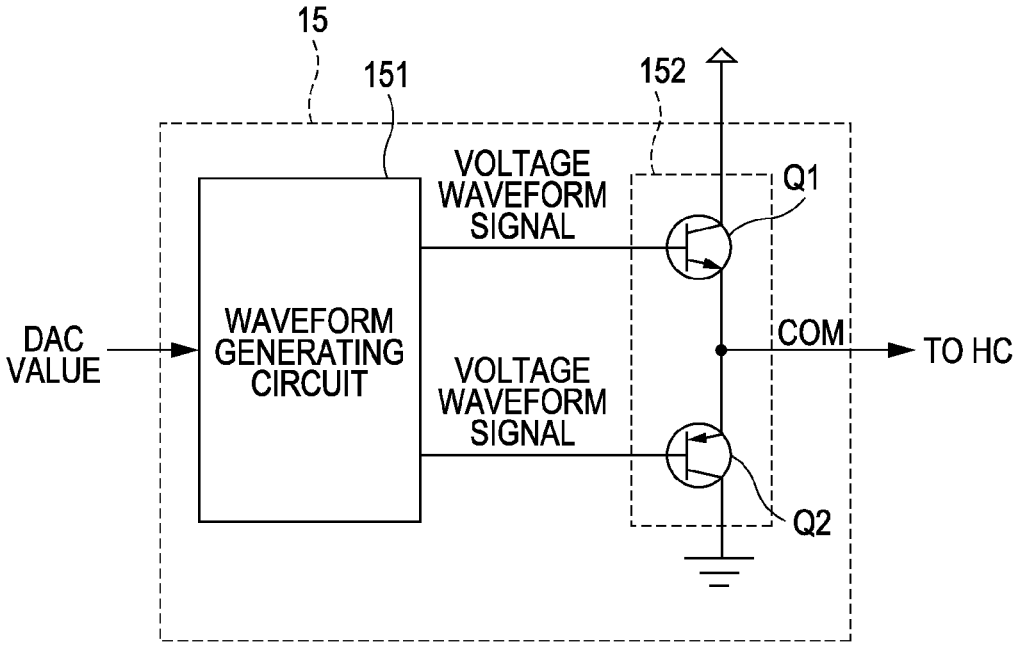
FIG. 3A is a view illustrating a drive signal generating circuit.
Figure 3B:
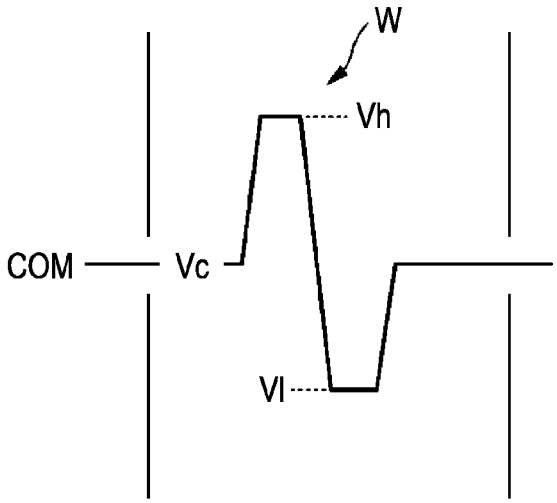
FIG. 3B is a view illustrating a waveform of a drive signal.

FIG. 3A is a view illustrating the drive signal generating circuit (drive signal generating unit) 15, and FIG. 3B is a view for explaining the waveform W of the drive signal COM. The drive signal generating circuit 15 has a waveform generating circuit 151 and a current amplifying circuit 152, and generates a drive signal COM commonly used for the nozzle rows. First, the waveform generating circuit 151 generates a voltage waveform signal (waveform information of an analog signal), i.e. a basis of the drive signal COM based on a DAC value (waveform information of a digital signal). The current amplifying circuit 152 amplifies a current of a voltage waveform signal to output the amplified current as a drive signal COM.

The current amplifying circuit 152 has a rising transistor (an NPN type transistor) Q1 operated during the rising of the voltage of the drive signal COM and a dropping transistor (a PNP type transistor) Q2 operated during the dropping of the voltage of the drive signal COM. The collector of the rising transistor Q1 is connected to a power source, and the emitter thereof is connected to an output signal line of the drive signal COM. The collector of the dropping transistor Q2 is connected to the ground (earth), and the emitter thereof is connected to an output signal line of the drive signal COM.

If the rising transistor Q1 is turned on by the voltage waveform signal from the waveform generating circuit 151, the drive signal COM rises to charge the piezo elements PZT. Meanwhile, if the dropping transistor Q2 is turned on by the voltage waveform signal, the drive signal COM drops to discharge the piezo elements PZT. Accordingly, a drive signal COM in which a waveform (potential change) is generated as in FIG. 3B is generated.

For example, the waveform W illustrated in FIG. 3B is applied to a piezo element. When a midpoint potential Vc is applied to the piezo element, the piezo element is not flexibly deformed, and the pressure (capacity) of the pressure chamber 412*d* becomes a reference value. Thereafter, as the potential applied to the piezo element rises from the midpoint potential Vc to a highest potential Vh, the pressure chamber 412*d* expands (the pressure decreases). After the expansion state is maintained for a predetermined time period, as the potential applied to the piezo element drops from a highest potential Vh to a lowest potential Vl, the pressure chamber 412*d* contracts (the pressure increases) to discharge ink droplets from the nozzle. The discharge of ink droplets from the nozzle can be controlled depending on whether or not the waveform W is applied to the piezo element.

Since a semiconductor constituting transistors Q1 and Q2 of the drive signal generating circuit 15 has a point called a bonding portion (not shown), the bonding portion emits heat if currents flow through the transistors Q1 and Q2 when a drive signal is generated. If currents flow though the transistors Q1 and Q2 for a long period of time due to a lengthy printing operation, the transistors may excessively emit heat so that the transistors Q1 and Q2 are broken. Accordingly, it is preferable that temperature sensors are provided in the vicinity of the transistors Q1 and Q2 to manage the temperatures of the transistors Q1 and Q2, thereby preventing excessive heat emission.

Head Controller HC

Figure 4:
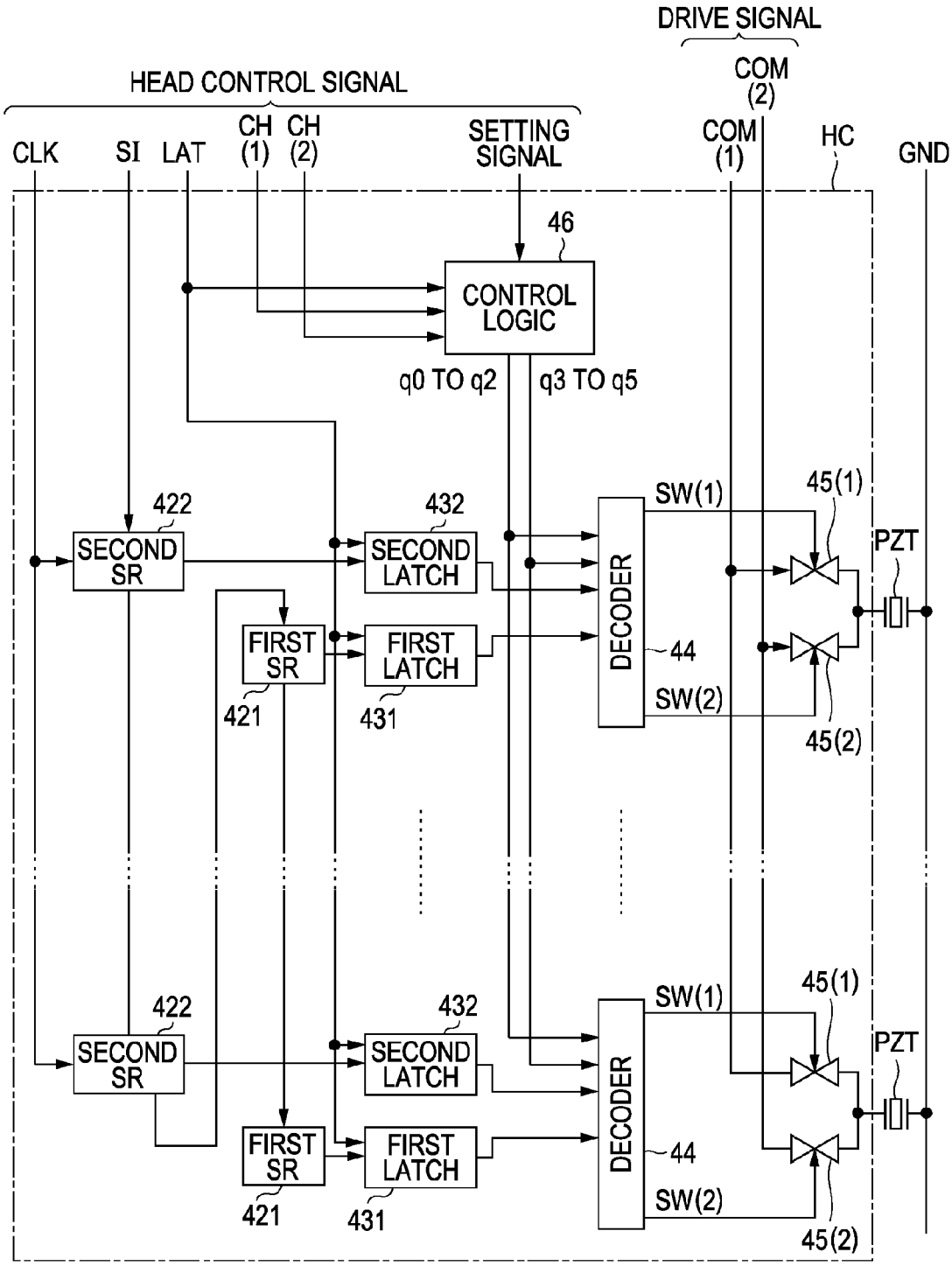
FIG. 4 is a view illustrating a head control unit.

FIG. 4 is a view illustrating the head controller HC. The head controller HC has a first shift register 421, a second shift register 422, a first latch circuit 431, a second latch circuit 432, a decoder 44, a first switch 45(1), and a second switch 45(2) for each piezo element (group) PZT, and also has a control logic 46.

In this case, dot forming data SI of two bits are sent from the controller 10 to the head controller HC in one pixel (a unit region virtually determined on a paper sheet). The higher bit of the dot forming data SI is set in the first shift register 421, and the lower bit thereof is set in the second shift register 422. At a timing defined by a latch signal LAT, the first latch circuit 431 latches the data set in the first shift register 421 and the second latch circuit 432 latches the data set in the second shift register 422. As being latched by the first latch circuit 431 and the second latch circuit 432, the serial-transmitted dot forming data SI form sets with the nozzles Nz. The decoder 44 performs a decoding operation based on the dot forming data SI from the first latch circuit 431 and the second latch circuit 432 to output switch control signals SW(1) and SW(2) for controlling the first switch 45(1) and the second switch 45(2). The switch control signals SW are selected from a plurality of types of (below-described) selection data q0 to q5 output from the control logic 46. Here, two types of drive signals COM(1) and COM(2) are input to one head controller HC (this will be described below). The first switch 45(1) controls application of the first drive signal COM(1) to a piezo element based on the first switch control signal SW(1), and the second switch 45(2) controls application of the second drive signal COM(2) to the piezo element based on the second switch control signal SW(2).

Waveform W Applied to Piezo Element

Figure 5:
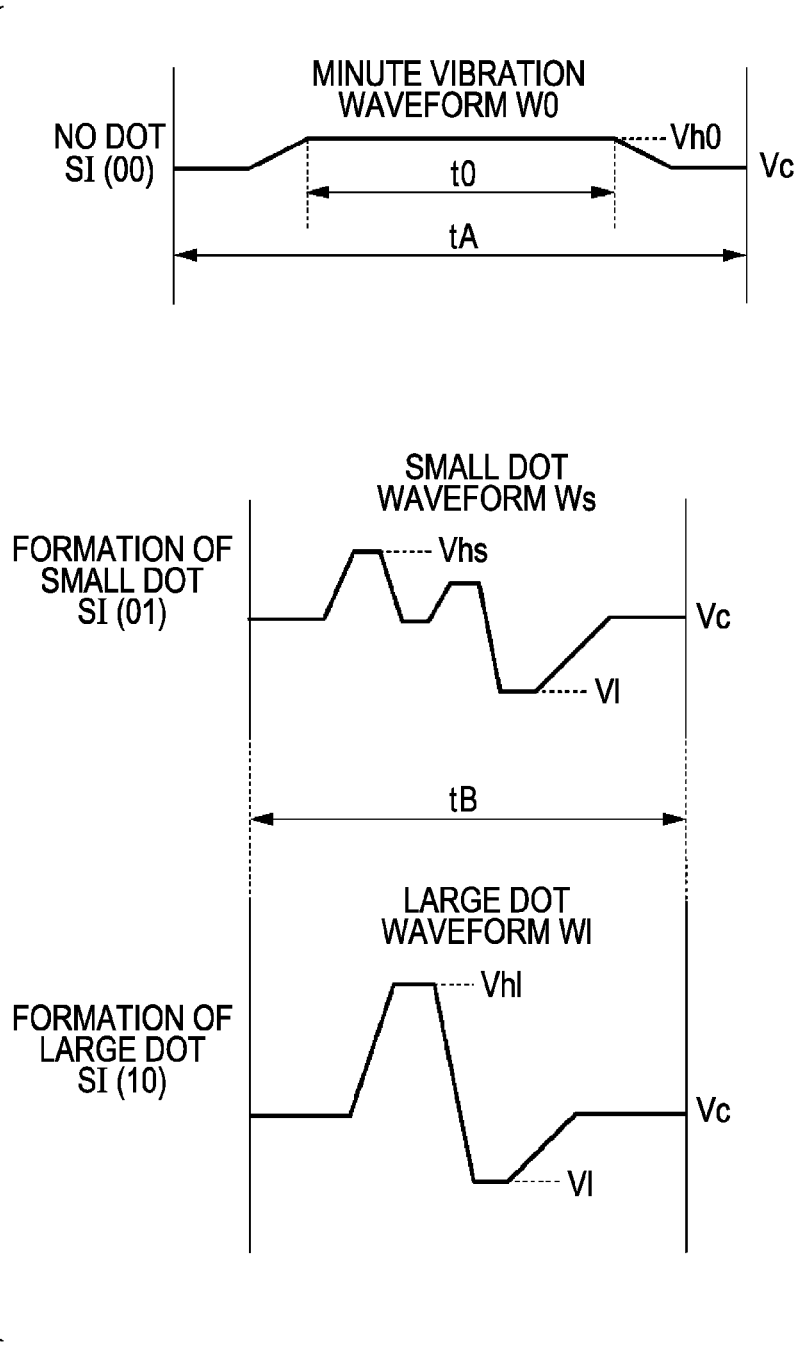
FIG. 5 is a view illustrating the shapes of waveforms according to drive operations of a piezo element.

FIG. 5 is a view illustrating the shape of a waveform W depending on a drive operation of a piezo element. In this case, dots (a large dot and a small dot) of two sizes are formed with respect to one pixel. Accordingly, one pixel may be expressed as three groups of "No dot", "Formation of small dot", and "Formation of large dot". The way the pixels are expressed may be determined based on the dot forming data SI. As described above, the dot forming data SI are two bit data, and as illustrated in FIG. 5, the dot forming data SI corresponding to "No dot" are set to "00", and the dot forming data SI corresponding to "Formation of small dot" are set to "01", and the dot forming data SI corresponding to "Formation of large dot" are set to "10".

When the dot forming data SI represent "No dot (00)", a small pressure change not enough to discharge ink droplets from a nozzle is generated in the pressure chamber 412*d*, thereby minutely vibrating a meniscus (a free surface of the ink exposed from the nozzle). Accordingly, even when ink droplets are not discharged from a nozzle, the meniscus can be prevented from being dried to prevent blocking of the nozzle. Thus, as illustrated in FIG. 5, "Minute vibration waveform W0" may be applied to a piezo element. In more detail, the potential applied to a piezo element rises from a midpoint potential Vc to a highest potential Vh0 in a smooth gradient. Accordingly, the pressure chamber 412*d* corresponding to the piezo element slowly expands. Then, after the highest potential Vh0 is applied to the piezo element for a time period t0, the potential applied to the piezo element drops in a smooth gradient from the highest potential Vh0 to the midpoint potential Vc. The meniscus can be minutely vibrated by varying the potential applied to the piezo element as in the minute vibration waveform W0 without discharging ink droplets from the nozzle.

Likewise, when the dot forming data SI represent "Formation of small dot (01)", the piezo element can be flexibly deformed so that an amount (for example, 2.6 pl) of ink corresponding to the small dot is discharged from the nozzle by applying an illustrated small dot waveform Ws to the piezo element. When the dot forming data SI represent "Formation of large dot (10)", the piezo element can be flexibly deformed so that an amount (for example, 7 pl) of ink corresponding to the large dot is discharged from the nozzle by applying an illustrated large dot waveform Wl to the piezo element.

As compared with the discharge of ink droplets from a nozzle, when a meniscus minutely vibrates, it is necessary to secure not less than a predetermined time period t0 in order to maintain a piezo element at a highest potential Vh0 without rapidly changing the potential applied to the piezo element. Therefore, "a time period tA", i.e the length of a minute vibration waveform W0 is longer than "a time period tB", i.e. the length of the small dot waveform Ws and the length of the large dot waveform Wl.

If the three waveforms W0, Ws, and Wl are sequentially generated by one drive signal COM, the three waveforms are repeatedly generated for each pixel, lengthening a cycle period T. Therefore, in the embodiment of the invention, three waveforms (voltage variations) are generated by two drive signals COM(1) and COM(2). Accordingly, as illustrated in FIG. 4, two drive signals COM(1) and COM(2) are input to the head controller HC of an arbitrary nozzle group (a nozzle row). One of the drive signals is referred to as "a first drive signal COM(1)", and the other of the drive signals is referred to as "a second drive signal COM(2)". Further, in order to generate two drive signals, two drive signal generating circuits 15 as illustrated in FIG. 3A are provided for each nozzle group.

Drive Signals of Comparison Example

First Comparison Example

Figure 6:
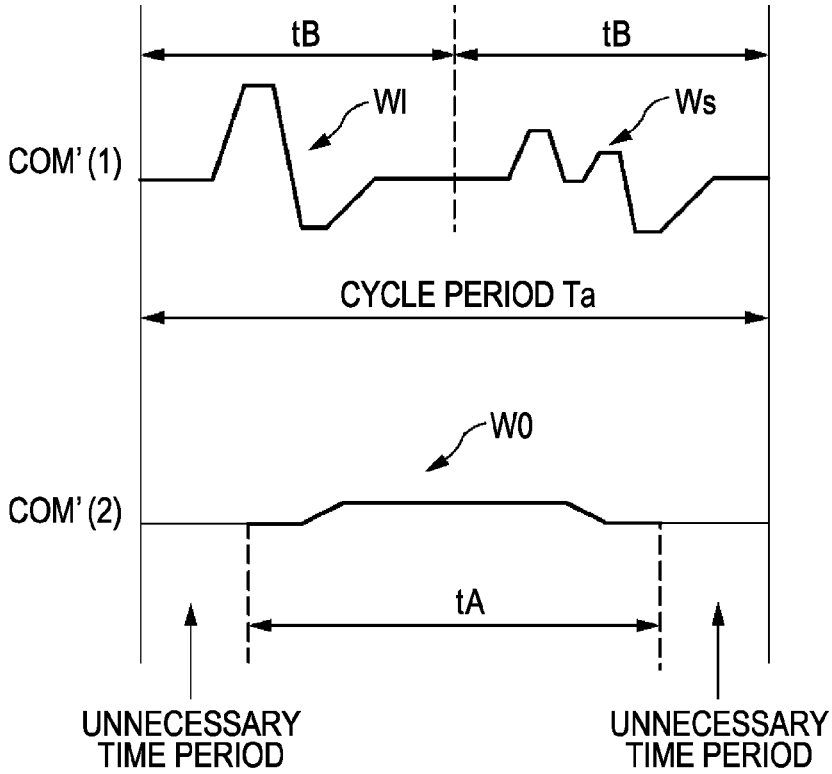
FIG. 6 is a view illustrating a first drive signal and a second drive signal of a first comparison example.

FIG. 6 is a view illustrating a first drive signal COM'(1) and a second drive signal COM'(2) of a first comparison example that is different from the embodiment of the invention. In the first drive signal COM'(1), a large dot waveform Wl is generated first, and then a small dot waveform Ws is generated in a cycle period Ta. Meanwhile, only a minute vibration waveform W0 is generated in the second waveform signal COM'(2).

For example, when the drive signals COM'(1) and COM'(2) are input to the head controller HC (refer to FIG. 4), in the case in which the dot forming signal SI represents "No dot (00)", a second switch 45(2) is turned on to apply the minute vibration waveform W0 of the second drive signal COM'(2) to a piezo element and a first switch 45(1) is turned off not to apply the first drive signal COM'(1) to the piezo element. Accordingly, ink droplets are not discharged from a nozzle and the meniscus of the nozzle can be minutely vibrated. Meanwhile, in the case in which the dot forming signal SI represents "Formation of small dot (01)", the first switch 45(1) is turned on only for the second half of the cycle period Ta to apply the small dot waveform Ws to the piezo element. Further, in the case in which the dot forming signal SI represents "Formation of large dot (10)", the first switch 45(1) is turned on only for the first half of the cycle period Ta to apply the large dot waveform Wl to the piezo element.

In the first comparison example, among three (odd number) waveforms W0, Ws, and Wl illustrated in FIG. 5, two waveforms Wl and Ws are allocated to the first drive signal COM'(1) and one waveform W0 is allocated to the second drive signal COM'(2). As illustrated in FIG. 5, the length tA of the minute vibration waveform W0 is longest. Therefore, in order to shorten the cycle period Ta, the large dot waveform Wl and the small dot waveform Ws are generated by one drive signal COM'(1) and the minute vibration waveform W0 is generated by another drive signal COM'(2).

However, since the cycle period Ta corresponds to a time period for which one nozzle opposes one pixel, the cycle periods Ta of the two drive signals COM'(1) and COM'(2) need to be equal to each other. Therefore, in the first comparison example, the cycle period Ta (=2tB) needs to be determined depending on the first drive signal COM'(1) whose time period 2tB for the cycle period Ta is longer. In particular, if there is no gap between the generation time periods tA and tB of the three waveforms, "Unnecessary time periods" are generated, as illustrated, in the second drive signal COM'(2) in which only one drive waveform W0 is generated.

That is, as in the first comparison example, when the number of waveforms allocated to two drive signals COM or a gap is generated between the generation time periods of the waveforms, since the cycle period T is determined depending on a drive signal (Here, the first drive signal COM'(1)) whose time period (generation time period of a waveform) for the cycle period T is longer, the cycle period T becomes longer. In other words, in a drive signal (Here, the second drive signal COM'(2)) whose time period for the cycle period T is shorter, an unnecessary time period becomes longer.

Second Comparison Example

Figure 7:
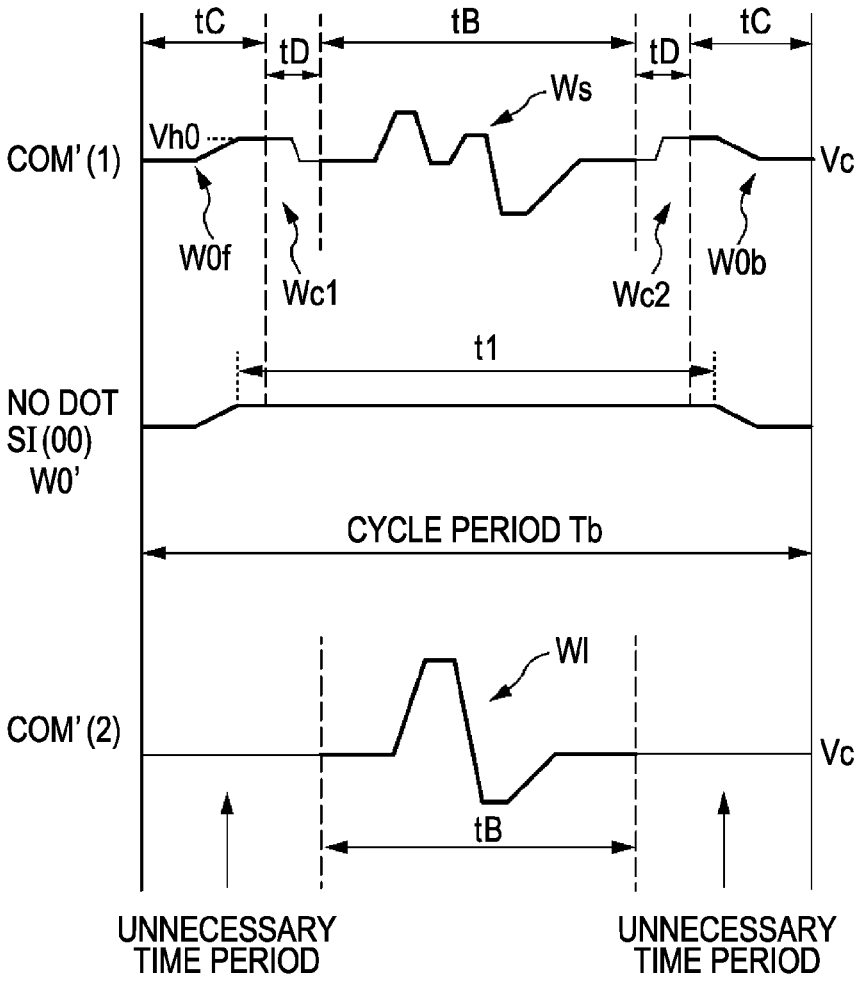
FIG. 7 is a view illustrating a first drive signal and a second drive signal of a second comparison example.

FIG. 7 is a view illustrating a first drive signal COM'(1) and a second drive signal COM'(2) of a second comparison example that is different from the embodiment of the invention. As illustrated in FIG. 5, in the minute vibration waveform W0, the highest potential Vh0 is maintained for a relatively long time t0. Thus, in the second comparison example, a small dot waveform Ws is generated for the maintenance time period t0 of the highest potential Vh0 of the minute vibration waveform W0. That is, in the second comparison example, a portion of a minute vibration waveform W0 and a small dot waveform Ws are allocated to the first drive signal COM'(1) and a large dot waveform Wl is allocated to the second drive signal COM'(2).

As illustrated in FIG. 7, in the first drive signal COM'(1), a front section W0*f* of the minute vibration waveform W0 is generated first. The front section W0*f* of the minute vibration waveform W0 refers to a waveform whose potential is varied from a midpoint potential Vc to a highest potential Vh0 in a smooth gradient. After the front section Wof of the minute vibration waveform W0 is generated, the highest potential Vh0 is returned to the midpoint potential Vc by an adjusting waveform Wc1. Accordingly, a small dot waveform Ws whose initial potential is the midpoint potential Vc can be generated next. Since the final potential of the small dot waveform Ws is the midpoint potential Vc, the midpoint potential Vc rises to the highest potential Vh0 of the minute vibration waveform W0 due to the adjusting waveform Wc2. Finally, a rear section W0*b* of the minute vibration waveform W0 is generated. The rear section W0*b* of the minute vibration waveform W0 refers to a waveform whose potential is varied from the highest potential Vh0 to the midpoint potential Vc in a smooth gradient. Only a large dot waveform Wl is generated in the second drive signal COM'(2).

When the drive signals COM'(1) and COM'(2) are input to the head controller HC, in the case in which the dot forming signal SI represents "Formation of large dot (10)", the second drive signal COM'(2) is input to the piezo element. Meanwhile, when the dot forming signal SI represents "Formation of small dot (01)", the first drive signal COM'(1) is applied to the piezo element only for the time period for which the small dot waveform Ws is generated in the first drive signal COM'(1).

In the case in which the dot forming signal SI represents "No dot (00)", the front section W0*f* of the minute vibration waveform is first applied to the piezo element in the first drive signal COM'(1), and then the drive signals COM'(1) and COM'(2) are not applied until the rear section W0*b* of the minute vibration waveform is applied to the piezo element. The highest potential Vh0 is maintained applied to the piezo element even if a drive signal is not applied after the front section W0*f* of the minute vibration waveform is applied. That is, the minute vibration waveform W0' as illustrated in FIG. 7 is applied to the piezo element.

That is, in the second comparison example, a small dot waveform Ws is generated between minute vibration waveforms W0 that maintain a predetermined potential Vh0 for a relatively long time period in the first drive signal COM'(1). Accordingly, as the meniscus minutely vibrates, a time period for which a predetermined potential Vh0 is continuously applied to the piezo element can be shortened. However, the generation time periods tB of the large dot waveform Wl and the small dot waveform Ws are substantially the same, a time period Tb necessary for the cycle period becomes longer in the first drive signal COM'(1) rather than in the second drive signal COM'(2) only for a time period 2tC for which the front section W0*f* and rear section W0*b* of the minute vibration waveform. In other words, an unnecessary time period is generated in the second drive signal COM'(2).

As originally illustrated in FIG. 5, when the maintenance time period of the highest potential Vh0 of the minute vibration waveform W0 is to be "t0", the maintenance time period t1 of the highest potential Vh0 of the minute vibration waveform W0' of the second comparison example becomes longer than t0. That is, the maintenance time period of the highest potential Vh0 is restricted by the generation time period tB of the small dot waveform Ws generated between the minute vibration waveforms W0. On the contrary, when the small dot waveform Ws generated between the minute vibration waveforms W0 is to be converged within the maintenance time period t0 of the highest potential Vh0 of the minute vibration waveform W0, the degree of freedom in design of the small dot waveform Ws is restricted. That is, when a waveform is generated between the waveforms that maintains a predetermined potential, the degree of freedom in design of the waveforms is restricted.

As can be seen from the first comparison example and the second comparison example, if a gap occurs between generation time periods (the time period required for the cycle period T) of waveforms in the case in which the waveforms W0, Ws, and Wl for operating a piezo element are allocated to a plurality of drive signals COM(1) and COM(2), a cycle period T needs to be determined depending on a drive signal whose waveform generation time period is longer. As a result, in spite of the fact that an unnecessary time period is generated in the drive signal whose waveform generation time period is shorter, the cycle period T becomes longer, making a printing time longer.

Therefore, the object of the embodiment of the invention is to make the cycle period T as short as possible.

Drive Signal of Embodiment of Invention

First Embodiment

Figure 8:
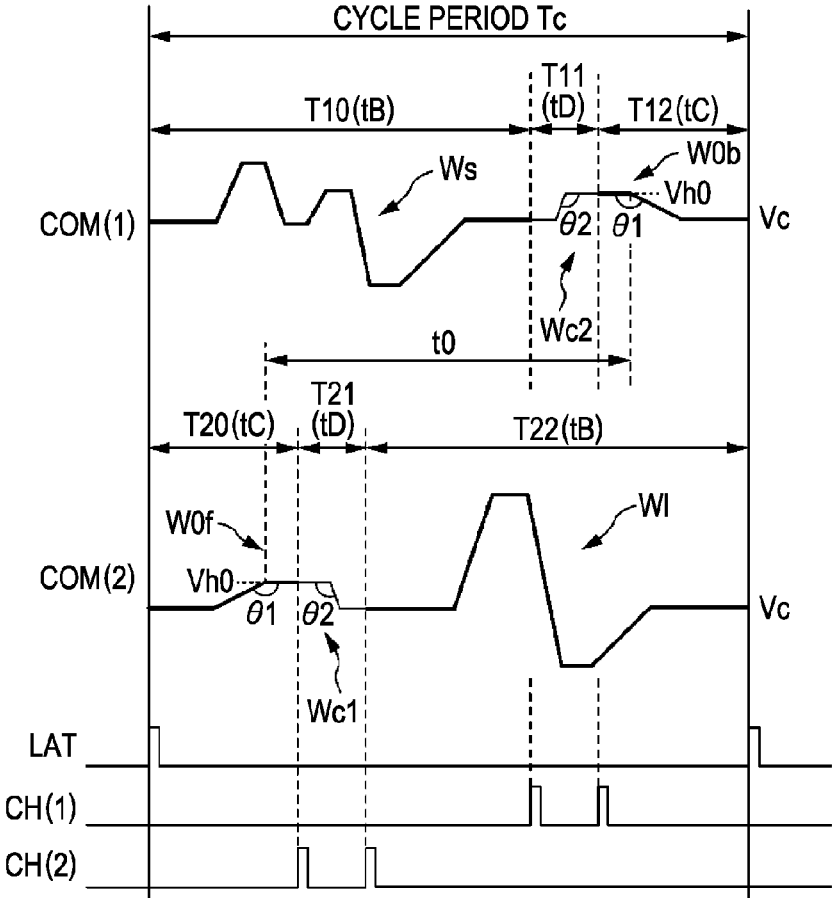
FIG. 8 is a view illustrating a first drive signal and a second drive signal of a first embodiment of the invention.

FIG. 8 is a view illustrating a first drive signal COM(1) and a second drive signal COM(2) in a first embodiment of the invention. In the first embodiment of the invention, a front section W0*f* of a minute vibration waveform W0 that maintains a predetermined potential Vh0 at a predetermined time period is generated in a second drive signal COM(2), and a rear section W0*b* of the minute vibration waveform W0 is generated in a first drive signal COM(1). A small dot waveform Ws is generated before the rear section W0*b* of the minute vibration waveform in the first drive signal COM(1), and a large dot waveform Wl is generated after the front section W0*f* of the minute vibration waveform in the second drive signal COM(2).

Hereinafter, the first drive signal COM(1) and the second drive signal COM(2) will be described in detail. First, a cycle period Tc (corresponding to a predetermined period) is initiated by a timing defined by a latch signal LAT. A small dot waveform Ws (corresponding to the first drive waveform) is generated for a time period T10 in the first drive signal COM(1). Thereafter, an adjusting waveform Wc2 whose potential rises from a midpoint potential Vc to a highest potential Vh0 of the minute vibration waveform W0 is generated for a time period T11 initiated at a timing of a first channel signal CH(1). Again, the rear section W0*b* of the minute vibration waveform (corresponding to the second drive waveform) is generated for a time period T12 initiated at a timing of the first channel signal CH(1).

Meanwhile, the front section W0*f* (corresponding to a third drive waveform) of the minute vibration waveform is generated for a time period T20 initiated at a timing of a latch signal LAT in the second drive signal COM(2). Thereafter, an adjusting waveform Wc1 dropping from the highest potential Vh0 of the minute vibration waveform W0 to a midpoint potential Vc is generated for a time period T21 initiated at a timing of a second channel signal CH(2). Again, the large dot waveform Wl (corresponding to a fourth drive waveform) is generated for a time period T22 initiated at a timing of the second channel signal CH(2).

The potentials of both the first drive signal COM(1) and the second drive signal COM(2) become the midpoint potential Vc at the final of the cycle period Tc. Accordingly, the initiating potential of the following cycle period Tc may become the midpoint potential Vc.

When the dot forming signal SI represents "No dot (00)", as illustrated in FIG. 8, the waveform Ws of the time period T10 of the first drive signal COM(1) and the waveform Wc2 of the time period T11 are not applied to a piezo element but the waveform W0*b* of the time period T12 is applied to the piezo element. The waveform W0*f* of the time period T20 of the second drive signal COM(2) is applied to the piezo element, but the waveform Wc1 of the time period T21 and the waveform Wl of the time period T22 are not applied to the piezo element. The final potential Vh0 of the front section W0*f* of the minute vibration waveform and the initial potential Vh0 of the rear section W0*b* of the minute vibration waveform are the same, and the highest potential Vh0 is maintained applied to the piezo element until the rear section W0*b* of the minute vibration waveform is applied to the piezo element after the front section W0*f* of the minute vibration waveform is applied to the piezo element. As a result, the piezo element is flexibly deformed (corresponding to a third operation) depending on the waveforms W0*f* and W0*b* applied to the piezo element, so that ink droplets are not ejected from a corresponding nozzle but a meniscus minutely vibrates.

Therefore, the selection data q0 corresponding to the first drive signal COM(1) of "No dot (00)" is set to "001", and the selection data q3 corresponding to the second drive signal COM(2) is set to "100". The selection data q0 to q5 are output from a control logic 46 as illustrated in FIG. 4, and those selected from the plurality of selection data q0 to q5 based on the dot forming signal SI correspond to the switch control signals SW(1) and SW(2). The selection data q0 to q2 represent the selection patterns of the waveforms Ws, Wc2, and W0*b* of the first drive signal COM(1), and the selection data q3 to q5 represent the selection patterns of the waves W0*f*, Wc1, and Wl of the second drive signal COM(2). Since both the first drive signal COM(1) and the second drive signal COM(2) have three waveforms respectively and the cycle period Tc is divided into three time periods, the selection data are data of three bits. The contents (whether or not waveforms are applied) of selection data q0 to q5 are exchanged at a timing defined by the first change signal CH(1) or the second change signal CH(2).

In the same manner, when the dot forming data SI represents "Formation of small dot (01)", the selection signal q1 for the first drive signal COM(1) is set to "100" and the selection signal q4 for the second drive signal COM(2) is set to "000". Accordingly, the small dot waveform Ws of the time period T10 of the first drive signal COM(1) is applied to the piezo element, and the other waveforms are not applied to the piezo element. Thus, the piezo element is flexibly deformed (corresponding to a first operation) depending on the applied waveform Ws, thereby ejecting the amount of ink corresponding to the small dot from the nozzle. When the dot forming data SI represents "Formation of large dot (10)", the selection signal q2 for the first drive signal COM(1) is set to "000" and the selection signal q5 for the second drive signal COM(2) is set to "001". Accordingly, the large dot waveform Wl of the time period T22 of the second drive signal COM(2) is applied to the piezo element, and the other waveforms are not applied to the piezo element. Thus, the piezo element is flexibly deformed (corresponding to a second operation) depending on the applied waveform Wl, thereby ejecting the amount of ink corresponding to the large dot from the nozzle.

Here, the cycle periods (Ta of FIG. 6 and Tb of FIG. 7) of the drive signals of the comparison examples will be compared with the cycle period Tc (FIG. 8) of the drive signal of the first embodiment of the invention. The cycle period Ta (FIG. 6) of the first comparison example is a length (Ta=2tB) obtained by adding the generation time period tB of the large dot waveform Wl and the generation time period tB of the small dot waveforms Ws. The cycle period Tb of the second comparison example is a length (Tb=tB+2tC+2tD) obtained by adding the generation time periods 2tC of the front section W0*f* and rear section W0*b* of the minute vibration waveform, the generation time period 2tD of the adjusting waveforms Wc1 and Wc2, and the generation time period tB of the small dot waveform Ws. The cycle period Tc of the first embodiment of the invention is a length (Tc=tB+tC+tD) obtained by adding the generation time period tC of the front section W0*f* (or rear section W0*b*) of the minute vibration wave, the generation period tD of the adjusting waveform Wc2 (or Wc1), and the generation time period tB of the small dot waveform Ws (or large dot waveform Wl).

As compared with the cycle period Ta (=2tB) of the first comparison example, although an adjusting waveform Wc2 (or Wc1) for connecting different waveforms (for example, Ws and W0*b*) is necessary in the cycle period Tc (=tB+tC+tD) of the first embodiment of the invention, a portion of the time period for which the highest potential Vh of the minute vibration waveform W0 is maintained can be shortened and the cycle period T can be shortened. In other words, in the case in which the cycle period is shortened and a dot is not formed, the highest potential Vh0 of the minute vibration waveform W0 can be maintained applied to the piezo element for a relatively long time period. As a result, ink droplets are prevented from being ejected from a nozzle and a meniscus can minutely vibrate.

In the first embodiment of the invention, the front section W0*f* and rear section W0*b* of the minute vibration waveform are allocated to the two drive signals COM(1) and COM(2). Accordingly, as compared with the cycle period Tb (=tB+2tC+2tD) of the second comparison example, the time period tC for which the rear section W0*b* (or front section W0*f*) of the minute vibration waveform is generated and the time period tD for which an adjusting waveform Wc2 (or Wc1) for connecting different waveforms is generated can be shortened in the cycle period Tc (=tB+tC+tD) of the first embodiment of the invention.

In particular, in the embodiment of the invention, since the generation time periods tB of the small dot waveform Ws and the large dot waveform Wl are substantially the same, the front section W0*f* and rear section W0*b* of the minute vibration waveform are allocated to the two drive signals COM(1) and COM(2), thereby preventing long unnecessary time periods from being generated only in one drive signal and shortening the cycle period as shown in FIG. 7.

As illustrated in FIG. 5, the time period for which the highest potential Vh0 is maintained is longer than the time period for which the potential is varied between the midpoint potential Vc and the highest potential Vh0 in the minute vibration waveform W0. Accordingly, in the cycle period Tc, the time period tB for which the small dot waveform Ws (or large dot waveform Wl) is generated can be set to be longer than the time period (tC+tD) for which the remaining waves Wc2, W0*b* (or Wc1 or W0*f*) are generated. That is, the time period tB for which the small dot waveform Ws (first drive waveform) or the large dot waveform Wl (fourth drive waveform) is generated is longer than half the time period (Tc/2) of the cycle period Tc (tB>(Tc/2)). Therefore, it can be stated that the added time period 2tB of the small dot waveform Ws and the large dot waveform Wl is longer than the cycle period Tc (2tB>Tc). That is, in the first embodiment of the invention, the degree of freedom in the design of the waveforms Ws and Wl for discharging a defined amount of ink from a nozzle can be increased as compared with the waveforms W0*f* and W0*b* for minutely vibrating a meniscus, while shortening the cycle period T.

The adjusting waveforms Wc1 and Wc2 for connecting different waveforms are those that are not applied to a piezo element. Therefore, for example, a gradient θ2 from the midpoint potential Vc to the highest potential Vh0 of the adjusting waveform Wc2 is preferable to be set to be smaller than a gradient θ1 from the highest potential Vh0 of the rear section W0*b* of the minute vibration waveform to the midpoint potential Vc (θ2<θ1). This is because there is no problem of deterioration of the piezo element since the adjusting waveforms Wc2 and Wc1 are not applied to the piezo element even when the potential is rapidly varied. In addition, the cycle period Tc can be shortened further by rapidly varying the potential in the adjusting waveforms Wc2 and Wc1 and shortening the generation time period tD of the adjusting waveforms. Further, the degree of freedom in the design of the small dot waveform Ws and the large dot waveform Wlan be increased.

In the second comparison example (FIG. 7), the small dot waveform Ws is generated in the maintenance time period of the highest potential Vh0 of the minute vibration waveform W0. Due to this, the maintenance time period t1 of the highest potential Vh0 of the minute vibration waveform W0 is lengthened by the generation time period tB of the small dot waveform Ws, or the degree of freedom in the design of the small dot waveform Ws is restricted if the maintenance time period of the highest potential Vh0 of the minute vibration waveform W0 is set to a desired time period t0. On the contrary, in the first embodiment of the invention (FIG. 8), no waveform is generated before the small dot waveform Ws or after the large dot waveform Wl.

Therefore, a time period between a point where the potential reaches the highest potential Vh0 of the front section W0*f* of the minute vibration waveform and a point where the potential starts to drop from the highest potential Vh0 of the rear section W0*b* of the minute vibration waveform may be a desired time period t0. For example, when the generation time period of the small dot waveform Ws is longer than tB, the small dot waveform Ws may be generated even before the front section W0*f* of the minute vibration waveform. Likewise, when the generation time period of the large dot waveform Wl is longer than tB, the large dot waveform Wl may be generated even after the rear section W0*b* of the minute vibration waveform. Accordingly, although the cycle period becomes longer than the cycle period Tc as illustrated in FIG. 8, since ink droplets can be discharged from a nozzle using a desired waveform, the degree of freedom in the design of the waveforms in the first embodiment of the invention is higher than that in the second comparison example.

Meanwhile, as illustrated in FIG. 3A, when the potentials of the drive signals COM(1) and COM(2) are varied, current flows through the rising transistor Q1 or the dropping transistor Q2. Further, as a larger amount of current flows through the transistors Q1 and Q2, the bonding points of the transistors Q1 and Q2 are apt to emit more heat, causing the transistors Q1 and Q2 to break. Accordingly, if a large amount of currents flow through any one of the drive signal generating circuit 15 generating the first drive signal COM(1) and the drive signal generating circuit 15 generating the second drive signal COM(2), the transistors Q1 and Q2 of the drive signal generating circuit 15 emit heat excessively, possibly causing the transistors Q1 and Q2 to break. Generally (in particular, in a text document), ink droplets are rarely discharged simultaneously from all the nozzles of one nozzle row. In other words, it may mean that the number of drive elements to which waveforms W0*f* and W0*b* is applied for minutely vibrating meniscuses is relatively large. Accordingly, as in the first comparison example and the second comparison example, if waveforms W0, W0*f*, and W0*b* for minute vibration are generated only in one drive signal, only the transistors Q1 and Q2 of the drive signal generating circuit 15 generating the drive signal emit heat unequally.

To solve the problem, as in the first embodiment of the invention, the amount of emitted heat of the transistors Q1 and Q2 of the drive signal generating circuit 15 generating the first drive signal COM(1) and the second drive signal COM (2) can be distributed by generating the waves W0*f* and W0*b* for minute vibration in the first drive signal COM(1) and the second drive signal COM(2) respectively. As a result, the life spans of the transistors Q1 and Q2 of the drive signal generating circuit 15 can be lengthened.

In the first embodiment of the invention, the small dot waveform Ws starts to be generated before the large dot waveform Wl in the cycle period Tc. Here, it is assumed that the large dot waveform Wl is generated earlier than the small dot waveform Ws in the cycle period Tc. It is also assumed that small dots are formed in one of adjacent nozzles and large dots are formed in the other of the adjacent nozzles for a time period of the same cycle period.

As described above, since the generation time periods tB of the small dot waveform Ws and the large dot waveform Wl are longer than half (Tc/2) the cycle period Tc, the generation time period of the small dot waveform Ws and the generation time period of the large dot waveform Wl have an overlapping time period. As illustrated in FIG. 5, since the potential change (Vhs to Vl) of the small dot waveform Ws is smaller than the potential change Vhl to Vl of the large dot waveform Wl, a piezo element is flexibly deformed less (the deformation of a resilient membrane 412*i* is smaller) in the small dot forming nozzle and the amount of ink entering or exiting the common ink chamber 412*f* becomes smaller in the small dot forming nozzle in accordance with expansion or contraction of the pressure chamber 412*d* of the small dot forming nozzle is expanded or contracted.

Accordingly, when different dot is formed in the adjacent nozzles, if the large dot waveform Wl is generated earlier than the small dot waveform Ws, the pressure chamber 412*d* corresponding to the small dot forming nozzle starts to be deformed immediately before or after the large dot forming nozzle discharges ink droplets. As a result, the small dot forming nozzle may be influenced by the large dot forming nozzle. Thus, an appropriate amount of ink cannot be ejected from the nozzle, causing deterioration of the quality of an image. In particular, if the potential changes of the two waveforms Ws and Wl in the overlapping time period of the small dot waveform Ws and the large dot waveform Wl are opposite, ink droplets have more difficulty in being discharged from the small dot forming nozzle.

Therefore, as in the first embodiment of the invention, the small dot waveform Ws is generated earlier than the large dot waveform Wl in the cycle period Tc. Accordingly, ink droplets can be normally ejected from the small dot forming nozzle without being influenced by the large dot forming nozzle. Further, since the large dot forming nozzle is rarely influenced by the small dot forming nozzle, there is no problem if the small dot waveform Ws is generated first. Meanwhile, the first embodiment of the invention is not limited thereto, and the large dot waveform Wl may be generated earlier than the small dot waveform Ws in the cycle period Tc.

Drive Signal of Embodiment of Invention

Second Embodiment

Figure 9:
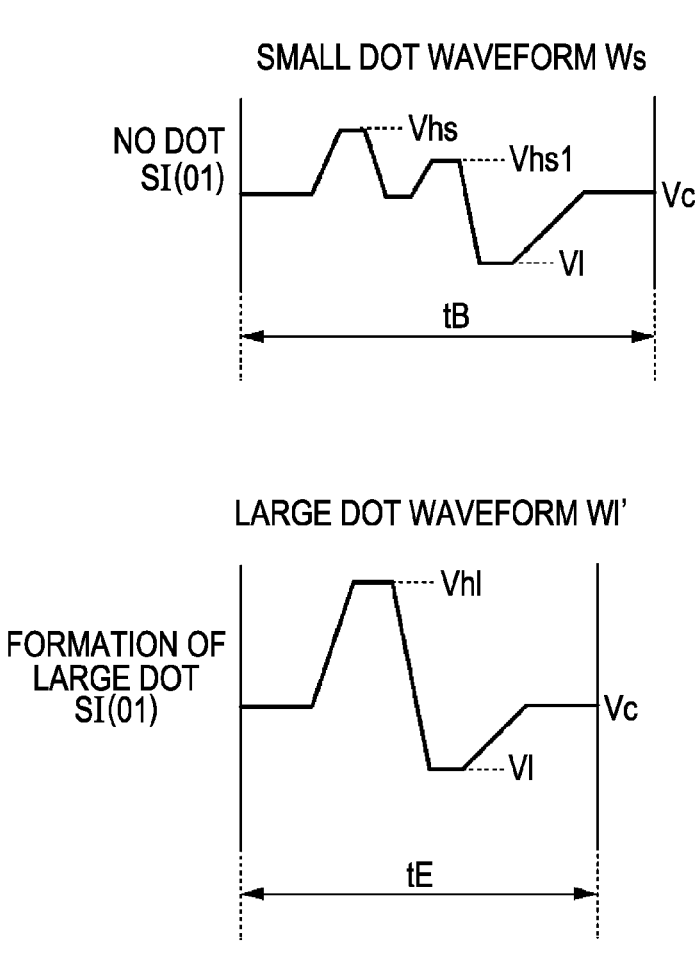
FIG. 9 is a view illustrating a small dot waveform and a large dot waveform of a second embodiment of the invention.

FIG. 9 is a view illustrating the same small dot waveform Ws as that illustrated in FIG. 5 and a large dot waveform Wl' different from the large dot waveform illustrated in FIG. 5. Although it has been assumed until now that the generation time periods tB of the small dot waveform Ws and the large dot waveform Wl are the same for convenience' sake, as illustrated in FIG. 9, the generation time period tE of the large dot waveform Wl' is shorter than the generation time period tB of the small dot waveform Ws in the second embodiment of the invention.

Figure 10A:
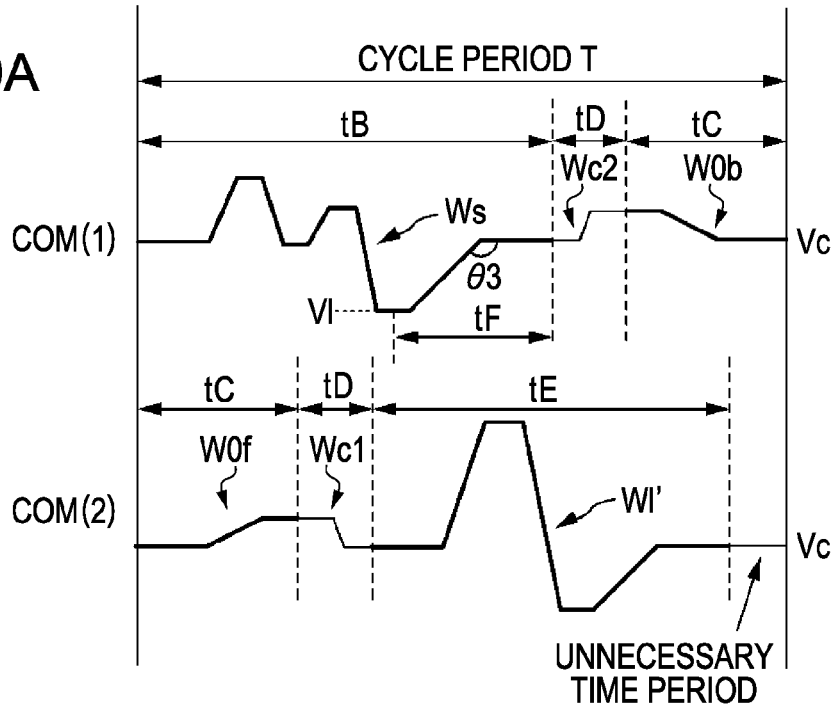
FIG. 10A is a view illustrating a first drive signal and a second drive signal of the first embodiment of the invention.
Figure 10B:
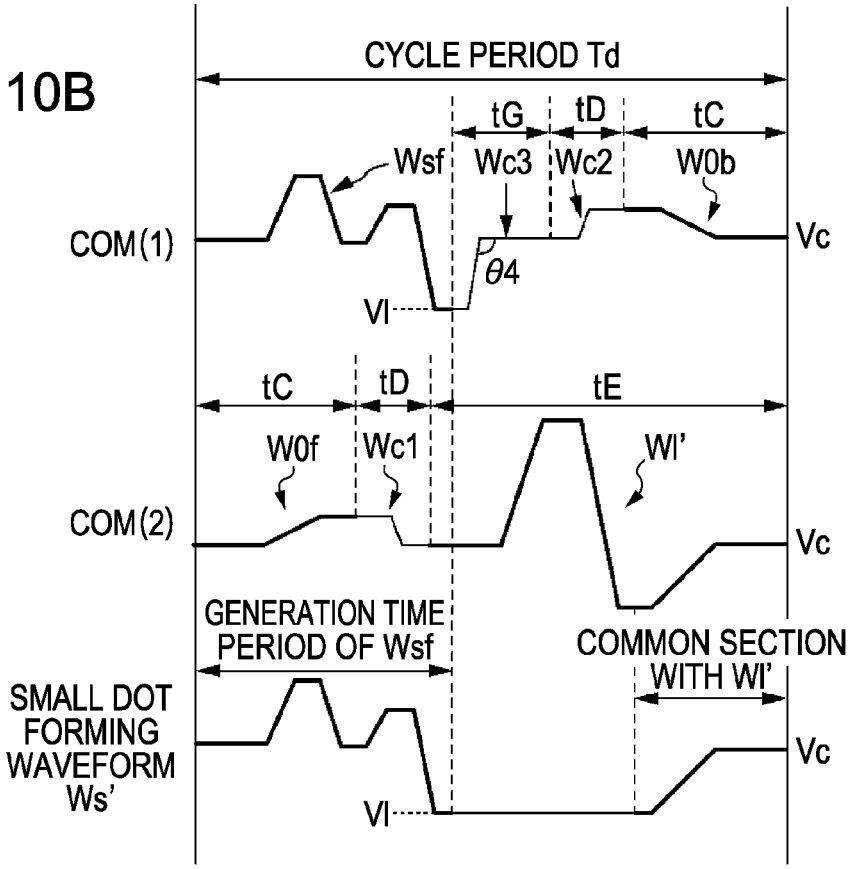
FIG. 10B is a view schematically illustrating a drive signal of the second embodiment of the invention.

FIG. 10A is a view illustrating allocation of the minute vibration waveform W0 to the first drive signal COM(1) and the second drive signal COM(2) as in the first embodiment of the invention when the generation time periods of the small dot waveform Ws and the large dot waveform Wl' are different, and FIG. 10B is a view schematically illustrating the drive signals COM(1) and COM(2) of the second embodiment of the invention. Since the generation time period tB of the small dot waveform Ws is longer than the generation time period tE of the large dot waveform Wl, "an unnecessary time period" is generated in the second drive signal COM(2).

Here, as in the small dot waveform Ws and the large dot waveform Wl' of FIG. 9, the lowest potentials Vl are the same, and the potential changes in which the potential rises from the lowest potential Vl to the midpoint potential Vc after the injection of ink droplets are the same. In the waveform applied to a drive element to form a small dot, it is possible that the maintenance time period of the lowest potential Vl is longer than the maintenance time period of the lowest potential Vl as shown in FIG. 9.

In this case, in the second embodiment of the invention, as illustrated in FIG. 10B, the waveform by which the potential rises from the lowest potential Vl to the midpoint potential Vc is commonly used in the waveform Ws' applied to the drive element to form a small dot and the waveform Wl' applied to the drive element to form a large dot. Accordingly, in the first drive signal COM(1) of the second embodiment of the invention (FIG. 10B), a waveform section (hereinafter, referred to as the "front section Wsf of the small dot wave") in which the potential is varied from the midpoint potential Vc to the lowest potential Vl in the small dot waveform Ws of FIG. 9 is generated. Further, in order to eject an amount of ink corresponding to the small dot from the nozzle, after the front section Wsf of the small dot waveform is applied to the piezo element, the rear section (the waveform section in which the potential rises from the lowest potential Vl to the midpoint potential Vc) of the large dot waveform Wl' is applied.

Accordingly, the cycle period Td of FIG. 10B to which the second embodiment of the invention is applied may become shorter than the cycle period T of FIG. 10A to which the first embodiment of the invention is applied. In more detail, since the waveform section in which the potential rises from the lowest potential Vl to the midpoint potential Vc is applied to the piezo element in the small dot waveform Ws of FIG. 10A, the potential rises in a relatively smooth gradient θ3. Meanwhile, in the first drive signal COM(1) of FIG. 10B, after the front section Wsf of the small dot waveform is generated, the waveform (adjusting waveform Wc3) in which the potential rises from the lowest potential Vl to the midpoint potential Vc is not applied to the piezo element. Therefore, in the adjusting waveform Wc3, the potential can rise in a rapid gradient θ4 as compared with the small dot waveform Ws of FIG. 10A (θ3>θ4). The time period tG for which the potential rises from the lowest potential Vl to the midpoint potential Vc in the adjusting waveform Wc3 of FIG. 10B can become shorter than the time period tF for which the potential rises from the lowest potential Vl to the midpoint potential Vc in the small dot waveform Ws of FIG. 10A. As a result, "an unnecessary time period" generated due to the generation time period of the small dot waveform Ws longer than that of the large dot waveform Wl' in the second drive signal COM(2) of FIG. 10A can be shortened in the second embodiment of the invention. That is, the cycle period Td of FIG. 10B to which the second embodiment of the invention is applied can become shorter than the cycle period T of FIG. 10A to which the first embodiment of the invention is applied.

Figure 11A:
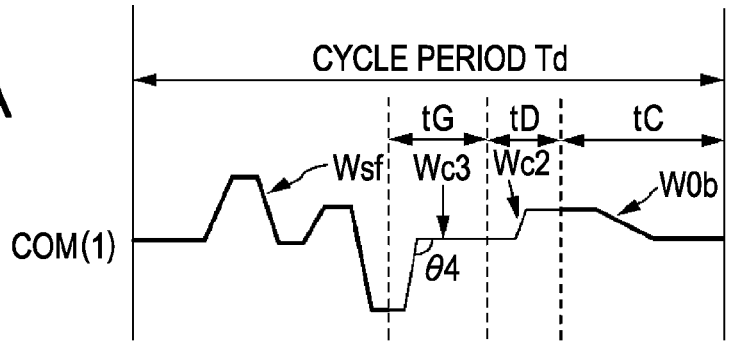
FIGS. 11A and 11B are views illustrating examples of adjusting waveforms.
Figure 11B:
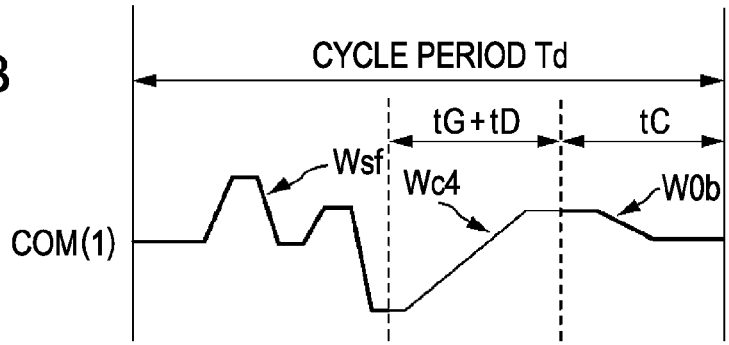

FIGS. 11A and 11B are views illustrating examples of adjusting waveforms connecting the front section Wsf of the small dot waveform and the rear section W0*b* of the minute vibration waveform in the first drive signal COM(1) of the second embodiment of the invention. As in FIG. 10B, in FIG. 11A, the front section Wsf of the small dot waveform and the rear section W0*b* of the minute vibration waveform are connected to each other by the adjusting waveform Wc3 in which the potential rises from the lowest potential Vl to the midpoint potential Vc in a rapid gradient θ4 and the adjusting waveform Wc2 in which the potential rises from the midpoint potential Vc to the highest potential Vh of the minute vibration waveform W0. The embodiment of the invention is not limited thereto, as in the adjusting waveform Wc4 illustrated in FIG. 11B, the front section Wsf of the small dot waveform and the rear section W0*b* of the minute vibration waveform may be connected to each other by the adjusting waveform Wc4 in which the potential rises from the lowest potential Vl to the highest potential Vh of the minute vibration waveform W0 at one try. In this case, the time period tG+tD of the adjusting waveform Wc4 can become shorter than the time period tF+tD obtained by adding the time period tF of the small dot waveform Ws and the time period tD of the adjusting waveform Wc2 in FIG. 10A by shortening the maintenance time period of the midpoint potential Vc.

Figure 12:
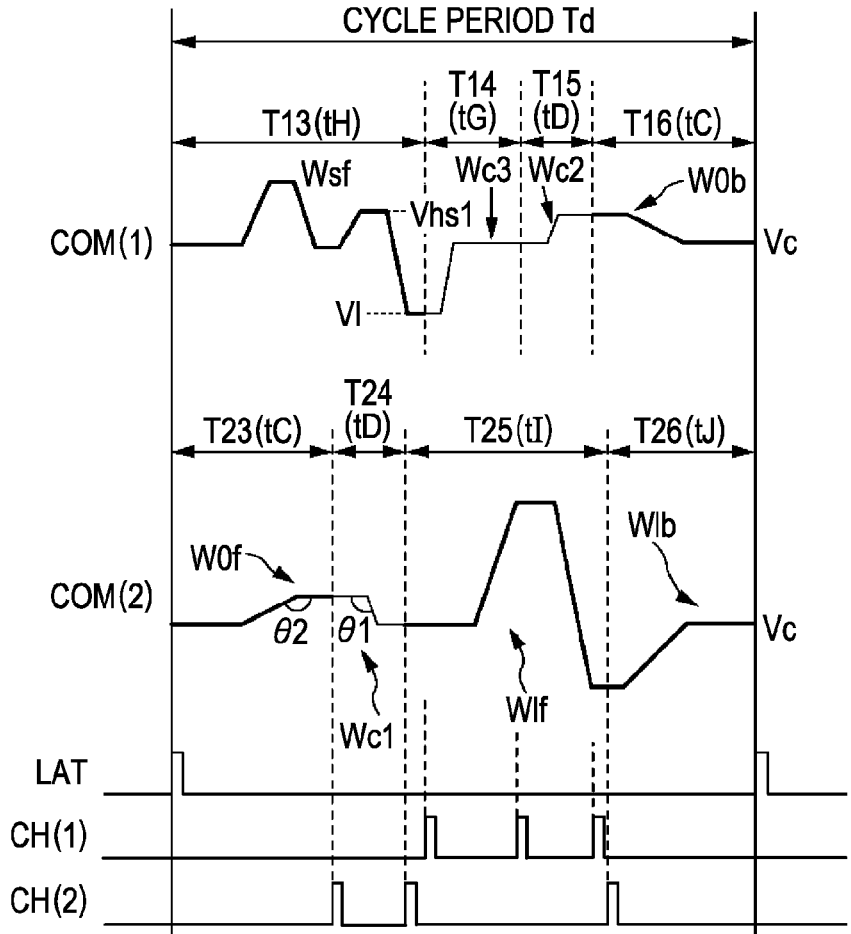
FIG. 12 is a view illustrating a first drive signal and a second drive signal of the second embodiment of the invention.

FIG. 12 is a view illustrating the first drive signal COM(1) and the second drive signal COM(2) of the second embodiment of the invention. In the first drive signal COM(1), the front section Wsf (corresponding to the first drive waveform) of the small dot waveform is generated in the time period T13. Thereafter, the adjusting waveform Wc3 (corresponding to the sixth drive waveform) in which the potential rises from the lowest potential Vl (corresponding to the final potential of the first drive waveform) to the midpoint potential Vc is generated in the time period T14 and the adjusting waveform Wc2 in which the potential rises from the midpoint potential Vc to the highest potential Vh0 of the minute vibration waveform W0 is generated in the time period T15. The rear section W0*b* (corresponding to the second drive waveform) of the minute vibration waveform is generated in the final time period T16.

Meanwhile, in the second drive signal COM(2), the front section W0*f* (corresponding to the third drive waveform) of the minute vibration waveform is generated in the time period T23, and then the adjusting waveform Wc1 is generated in the next time period T24. Thereafter, the front section Wlf (corresponding to the fourth drive waveform) of the large dot waveform Wl' (FIG. 9) is generated in the time period T25, and the rear section Wlb (corresponding to the fifth drive waveform) of the large dot waveform Wl' (or the small dot waveform Ws) in which the potential is varied from the lowest potential Vl (corresponding to the final potential of the fourth drive waveform) to the midpoint potential Vc is generated in the final time period T26.

In the drive signals COM(1) and COM(2), when the dot forming data SI represents "Formation of small dot (01)", the selection signal q1 for the first drive signal COM(1) is set to "1000", and the selection signal q4 for the second drive signal COM(2) is set to "0001". Accordingly, the waveform Wsf of the time period T13 of the first drive signal COM(1) is applied to the piezo element, and then the waveform Wlb of the time period T26 of the second drive signal COM(2) is applied to the piezo element. As a result, the piezo element is flexibly deformed (corresponding to the first operation) depending on the applied waveforms Wsf and Wlb, and an amount of ink corresponding to the small dot is ejected from the nozzle.

Likewise, when the dot forming data SI represents "Formation of large dot (10)", the selection signal q2 for the first drive signal COM(1) is set to "0000", and the selection signal q5 for the second drive signal COM(2) is set to "0011". Accordingly, if the waveform Wlf of the time period T25 and the waveform Wlb of the time period T26 of the second drive signal COM(2) are applied to the piezo element, the piezo element is flexibly deformed (corresponding to the second operation) depending on the applied waveforms Wlf and Wlb, thereby ejecting an amount of ink corresponding to a large dot from the nozzle. When the dot forming data SI represents "No dot (00)", the selection signal q0 for the first drive signal COM(1) is set to "0001" and the selection signal q3 for the second drive signal COM(2) is set to "1000". Accordingly, the waveform W0*f* of the time period T23 of the second drive signal COM(2) and the waveform W0*b* of the time period T15 of the first drive signal COM(1) are applied to the piezo element, minutely vibrating the meniscus without ejecting ink from the nozzle.

In this way, the waveform Wlb in which the potential rises from the final potential Vl to the midpoint potential Vc can be commonly used by making the final potential Vl of the front section Wsf of the small dot waveform and the final potential Vl of the front section Wlf of the large dot waveform the same. Further, the cycle period Td can be shortened further by making the generation time period tG of the adjusting waveform Wc3 generated after the front section Wsf of the small dot waveform shorter than the generation time period tJ of the rear section Wlb of the large dot waveform. The lowest potential Vl can be maintained applied to the piezo element for a relatively long time until the rear section Wlf of the large dot waveform is applied after the front section Wsf of the small dot waveform is applied to the piezo element, while shortening the cycle period Td.

In the embodiment of the invention, the minute vibration waveform W0 is not limited to being distributed to and generated in the first drive signal COM(1) and the second drive signal COM(2) and the cycle period T is not limited to being shortened. For example, like the small dot forming waveform Ws' of FIG. 10B, the waveform that maintains the lowest potential Vl for a predetermined time period may be distributed to and generated in the first drive signal COM(1) and the second drive signal COM(2). In this case, the small dot forming waveform Ws' is distributed to and generated in the first drive signal COM(1) and the second drive signal COM(2), with the border being the waveform section that maintains the lowest potential Vl for a predetermined time period. Accordingly, the amount of heat emitted from the transistors Q1 and Q2 of the drive signal generating circuits 15 generating the first drive signal COM(1) and the second drive signal COM (2) respectively can be distributed. Further, the section where the small dot forming waveform Ws' (FIG. 10B) is distributed to the two drive signals is desirably located behind the waveform section for ejecting ink droplets. This is so the ejection of ink droplets can be prevented from being influenced even when the potential difference occurs at the connecting portion of the waveforms generated by a small deviation in the generation potential (here, Vl) of a drive signal between the two drive signal generating circuits.

The waveform for forming dots of another size that maintains a specific potential for a predetermined time period other than the small dot forming waveform Ws' (FIG. 10B) may be distributed to and generated in two drive signals. Meanwhile, when the waveform W0 for minute vibration is distributed to and generated in two drive signals, the ejection of ink droplets and image quality are rarely influenced by the fact that a deviation is generated between the generation potentials between the two drive signal generating circuits and a potential difference is generated at a connecting portion of waveforms. Therefore, it is preferable that the waveform W0 for minute vibration is distributed to and generated in two drive signals.

Other Embodiments of Invention

Although the above-described embodiments of the invention describe a printing system mainly having an ink jet printer, they also disclose drive signals or the like. Further, the embodiments of the invention have been described for easy understanding of the invention, but do not limit the construction of the invention. It is apparent that the invention may be modified and improved without departing from the scope of the invention and may include its equivalents. In particular, the below-described embodiments are included in the invention.

Fluid Ejecting Apparatus

Although an ink jet printer is exemplified as a fluid ejecting apparatus in the above-described embodiments of the invention, the invention is not limited thereto. The fluid ejecting apparatus may be applied not only to a printer (printing apparatus) but to various industrial apparatus. For example, the present invention may be applied to a printing apparatus for patterning a fabric, a color filter manufacturing apparatus, a display manufacturing apparatus for an organic EL display, etc., a DNA chip manufacturing apparatus for coating a solution obtained by melting DNA with a chip to manufacture a DNA chip, etc.

Further, the fluid ejecting manner may be a piezo manner in which a fluid is ejected by applying a voltage to a drive element (piezo element) and expanding and contracting an ink chamber, or a thermal manner in which a fluid is discharged by bubbles generated in a nozzle using a heat emitting element.

Drive Waveform

Although a head 41 in which the pressure chamber 412*d* is expanded when a potential applied to a drive element rises and the pressure chamber 412*d* is contracted when the potential drops is used in the embodiments of the invention, the invention is not limited thereto. For example, a head in which a pressure chamber is contracted when a potential applied to a drive element rises and the pressure chamber is expanded when the potential drops may use a drive waveform obtained by reversing the upper and lower sides of the drive waveform illustrated in FIG. 3B.

What is claimed is:

1. A fluid ejecting apparatus comprising:

a drive element that performs a driving operation when a drive waveform is applied thereto;

a nozzle that ejects a fluid by the driving operation of the drive element;

a drive signal generating unit that generates a first drive signal in which a first drive waveform is generated prior to a second drive waveform in a predetermined period and a second drive signal in which a third drive waveform is generated prior to a fourth drive waveform of the predetermined period; and a control unit that applies the first drive waveform to the drive element so that the drive element performs a first operation, applies the fourth drive waveform to the drive element so that the drive element performs a second operation, and applies the second drive waveform to the drive element after applying the third drive waveform to the drive element, the second drive waveform and third drive waveform being combined to form a combined waveform which together cause the drive element to perform a third operation, wherein the combined drive waveform, and fourth drive waveform each consist of a single pulse-wave and the first drive waveform comprises a plurality of pulse-waves.

2. The fluid ejecting apparatus according to claim 1, wherein a time period for which the first drive waveform is generated is longer than half the predetermined period, and a time period for which the fourth drive waveform is generated is longer than half the predetermined period.

3. The fluid ejecting apparatus according to claim 1, wherein an amount of the fluid ejected from the nozzle corresponding to the drive element by the first operation of the drive element is smaller than an amount of the fluid ejected from the nozzle corresponding to the drive element by the second operation of the drive element.

4. The fluid ejecting apparatus according to claim 1, wherein a final potential of the third drive waveform is equal to an initial potential of the second drive waveform.

5. The fluid ejecting apparatus according to claim 1, wherein the fluid is not ejected from the nozzle corresponding to the drive element but a meniscus minutely vibrates by the third operation of the drive element.

6. The fluid ejecting apparatus according to claim 1, wherein a fifth drive waveform is generated behind the fourth drive waveform in the second drive signal, and the control unit applies the fifth drive waveform to the drive element after applying the first drive waveform to the drive element, so that the drive element performs the first operation, and applies the fifth drive waveform after applying the fourth drive waveform to the drive element, so that the drive element performs the second operation.

7. The fluid ejecting apparatus according to claim 6, wherein a sixth drive waveform whose potential is varied from a final potential of the first drive waveform to a midpoint potential is generated behind the first drive waveform in the first drive signal, the potential of the fifth drive waveform is varied from a final potential of the fourth drive waveform to the midpoint potential, the final potential of the first drive waveform is equal to the final potential of the fourth drive waveform, and a time period for which the sixth drive waveform is generated is shorter than a time period for which the fifth drive waveform is generated.

8. A fluid ejecting method in which a drive element performs a driving operation when a drive waveform is applied thereto so that a nozzle corresponding to the drive element ejects a fluid, the method comprising:

generating a first drive signal in which a first drive waveform is generated prior to a second drive waveform in a predetermined period and a second drive signal in which a third drive waveform is generated prior to a fourth drive waveform of the predetermined period;

applying the first drive waveform to the drive element so that the drive element performs a first operation;

applying the fourth drive waveform to the drive element so that the drive element performs a second operation; and applying the second drive waveform to the drive element after applying the third drive waveform to the drive element, the second drive waveform and third drive waveform being combined to form a combined waveform which together cause the drive element to perform a third operation, wherein the combined drive waveform, and fourth drive waveform each consist of a single pulse-wave and the first drive waveform comprises a plurality of pulse-waves.

* * * * *